US007025216B2

(12) United States Patent
Kaczmarek

(10) Patent No.: US 7,025,216 B2
(45) Date of Patent: Apr. 11, 2006

(54) CAP FOR HOUSEHOLD APPLIANCES

(75) Inventor: Wolfgang Kaczmarek, Schwindegg (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 21 days.

(21) Appl. No.: 10/462,236

(22) Filed: Jun. 16, 2003

(65) Prior Publication Data

US 2003/0222085 A1 Dec. 4, 2003

Related U.S. Application Data

(63) Continuation of application No. PCT/EP01/13845, filed on Nov. 27, 2001.

(30) Foreign Application Priority Data

Dec. 14, 2000 (DE) ..... 200 21 158 U

(51) Int. Cl.
*A47F 3/14* (2006.01)

(52) U.S. Cl. ..... 211/133.6; 211/41.4; 211/10; 211/126.1

(58) Field of Classification Search ..... 211/10, 211/11, 126.1, 133.6, 41.1, 127.1, 45, 84, 211/85.25, 85.26, 85.4; 108/27; 206/557
See application file for complete search history.

(56) References Cited

U.S. PATENT DOCUMENTS

| | | | | |
|---|---|---|---|---|
| 1,389,908 | A * | 9/1921 | Shults et al. | 211/85.25 |
| 2,257,188 | A * | 9/1941 | Page | 211/133.6 |
| 3,269,555 | A * | 8/1966 | Henderson | 211/86.01 |
| 4,974,502 | A * | 12/1990 | Murdock | 99/426 |
| 5,823,366 | A * | 10/1998 | Bellamy | 211/119.011 |
| 6,216,894 | B1 * | 4/2001 | Hendricks | 211/194 |
| 6,386,378 | B1 * | 5/2002 | Scharing | 211/86.01 |
| 6,497,330 | B1 * | 12/2002 | Van Der Linden et al. | 211/133.6 |

FOREIGN PATENT DOCUMENTS

| | | |
|---|---|---|
| DE | 3326445 A1 | 1/1985 |
| DE | 19750946 A1 | 10/1998 |
| DE | 19860186 A1 | 12/1999 |
| FR | 2595937 | 9/1987 |

* cited by examiner

*Primary Examiner*—Jennifer E. Novosad
(74) *Attorney, Agent, or Firm*—John T. Winburn; Russell W. Warmock; Craig J. Loest

(57) ABSTRACT

A cover plate for household appliances having enhanced utilization potential by being at least partially provided with a raised edge on a perimeter thereof.

2 Claims, 4 Drawing Sheets

CAP FOR HOUSEHOLD APPLIANCES

CROSS-REFERENCE TO RELATED APPLICATION

This application is a continuation of copending International Application No. PCT/EP01/13845, filed Nov. 27, 2001, which designated the United States and was not published in English.

BACKGROUND OF THE INVENTION

Field of the Invention

The invention relates to a cap for household appliances.

Appliances such as dishwashers, washing machines, refrigerators, and others, to the extent that they are constructed as upright appliances, have a cap on top that can usually serve only as a simple storage surface for all sorts of objects. Small appliances such as compact dishwashers, which are typically placed on the countertop over kitchen base cabinets, reduce the useful surface of the countertop.

SUMMARY OF THE INVENTION

It is accordingly an object of the invention to provide a cap for household appliances that overcomes the hereinafore-mentioned disadvantages of the heretofore-known devices of this general type and that substantially expands the utility of the cap. The cap can also be referred to as a cover plate or lid.

With the foregoing and other objects in view, there is provided, in accordance with the invention, a cap at least partly with a raised margin around its periphery. The at least partial elevation of the peripheral margin of the cap provides security against the falling of objects that have been placed on the cap. Circular or spherical objects can, thus, be placed on such a cap without risk of their falling off. A cap for appliances is inventively created, the utility of which is substantially enhanced.

In accordance with another feature of the invention, it is particularly expedient when the cap is constructed as a tray. In such a case, the cap can serve as a trough for a wire basket that can be loaded with items, i.e., wet dishes.

In accordance with a further feature of the invention, it is also possible to insert various removable parts into a tray-type cap of this kind, thereby creating storage options for a variety of objects.

In accordance with an added feature of the invention, the cap is shaped to receive a removable wire railing therein.

In accordance with an additional feature of the invention, the cap is removably placed on an appliance. Because it is removably placed on the appliance, the cap can be removed therefrom for washing or safekeeping.

Another possibility is to construct the surface of the cap as a cutting surface. In accordance with a concomitant feature of the invention, the cap is shaped to receive a removable cutting surface therein.

Other features that are considered as characteristic for the invention are set forth in the appended claims.

Although the invention is illustrated and described herein as embodied in a cap for household appliances, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
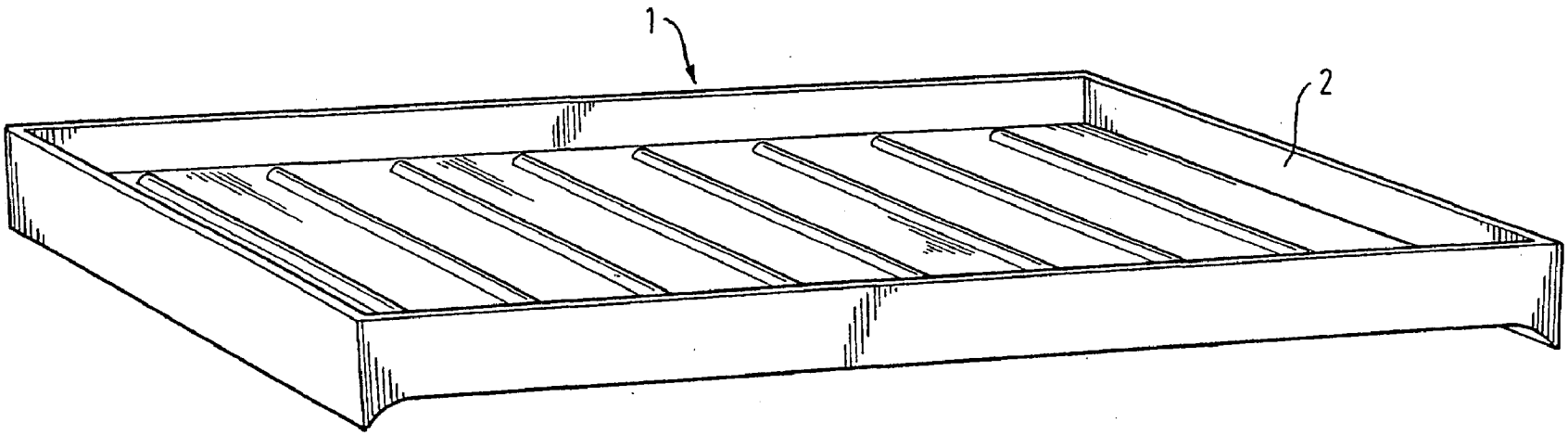
FIG. 1 is a perspective view of a cap according to the invention constructed overall as a tray.

Referring now to the figures of the drawings in detail and first, particularly to FIG. 1 thereof, there is shown a cap 1 whose bottom side has a contour suited to being placed on an appliance such as a refrigerator, dishwasher (particularly, a compact dishwasher), or other device. That is to say, the contour of a bottom of the cap 1 is adapted to the contour of a top side of the relevant household appliance. Such a configuration guarantees that the cap 1 sits securely on the appliance.

On a top surface thereof, the cap 1 has a raised margin 2 that extends around its entire perimeter. Thus, the cap 1 is shaped like a tray.

Figure 2:
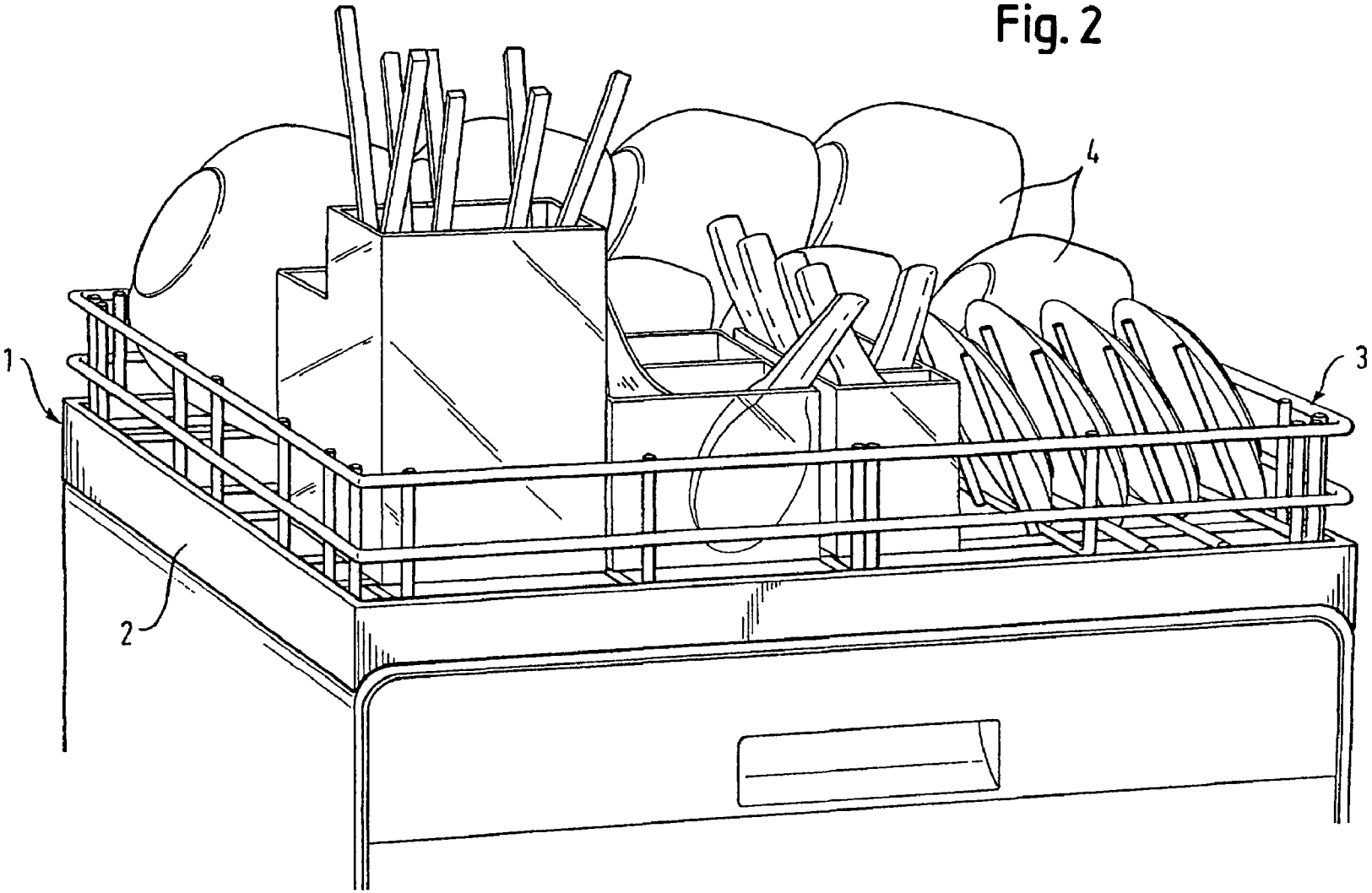
FIG. 2 is a perspective view of a cap according to the invention placed on an appliance and serving as a trough for a wire basket that can be loaded with wet dishes.

As represented in FIG. 2, such a cap 1 with a tray shape can be, advantageously, utilized as a trough for a wire basket 3 in which wet dishes 4 can be loaded for drip-drying. The wire basket 3 can also be used for keeping dry dishes 4.

Figure 3:
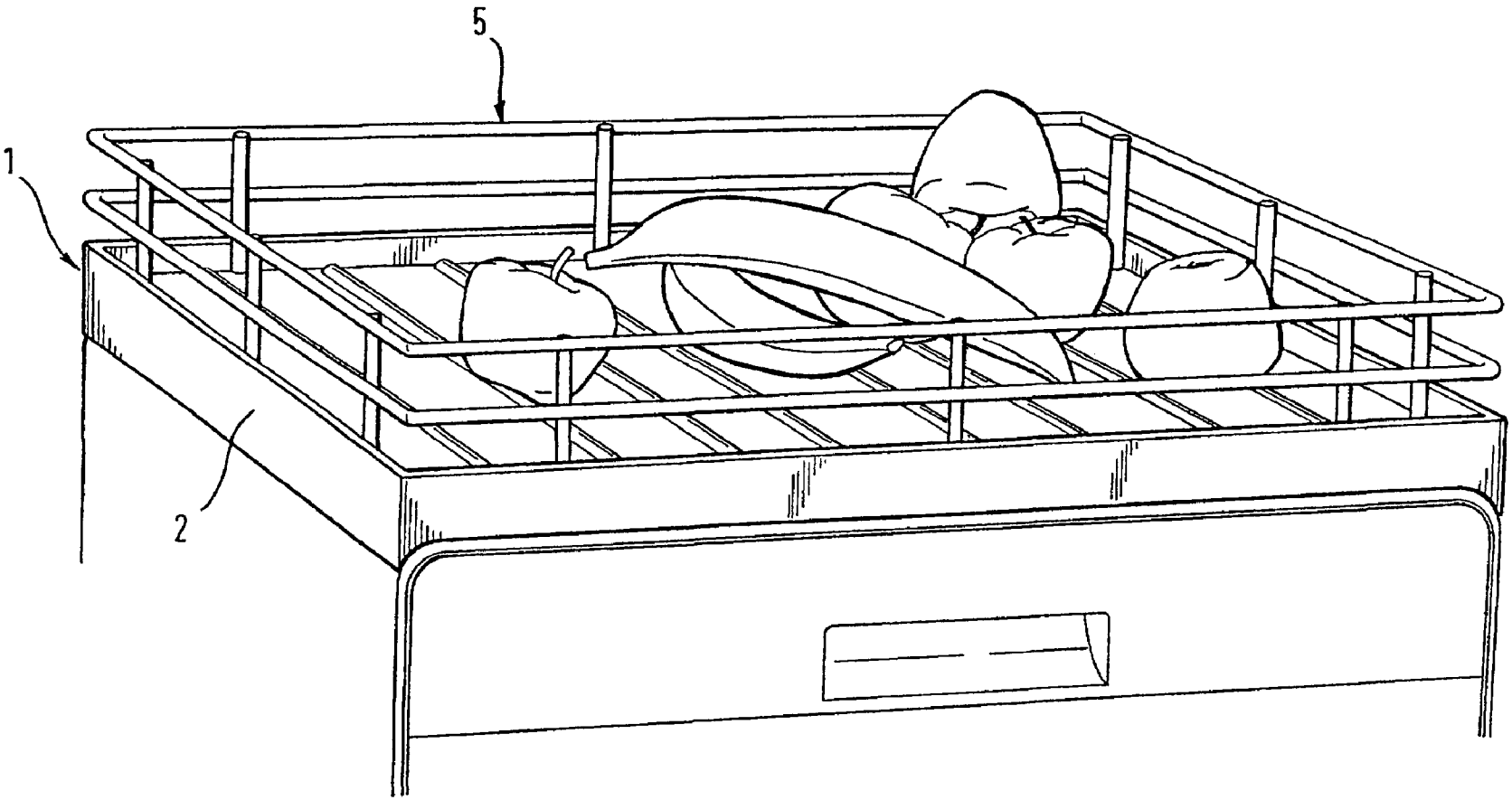
FIG. 3 is a perspective view of a cap according to the invention placed on an appliance, the cap having an attached wire railing.

Given the insertion of a wire railing 5 in the tray-shaped depression of the cap 1 as represented in FIG. 3, other items, such as fruit or small kitchen appliances, like mixers, water heaters, or other devices, can be placed on the cap 1, without there being a risk of the items falling off the cap 1.

Figure 4:
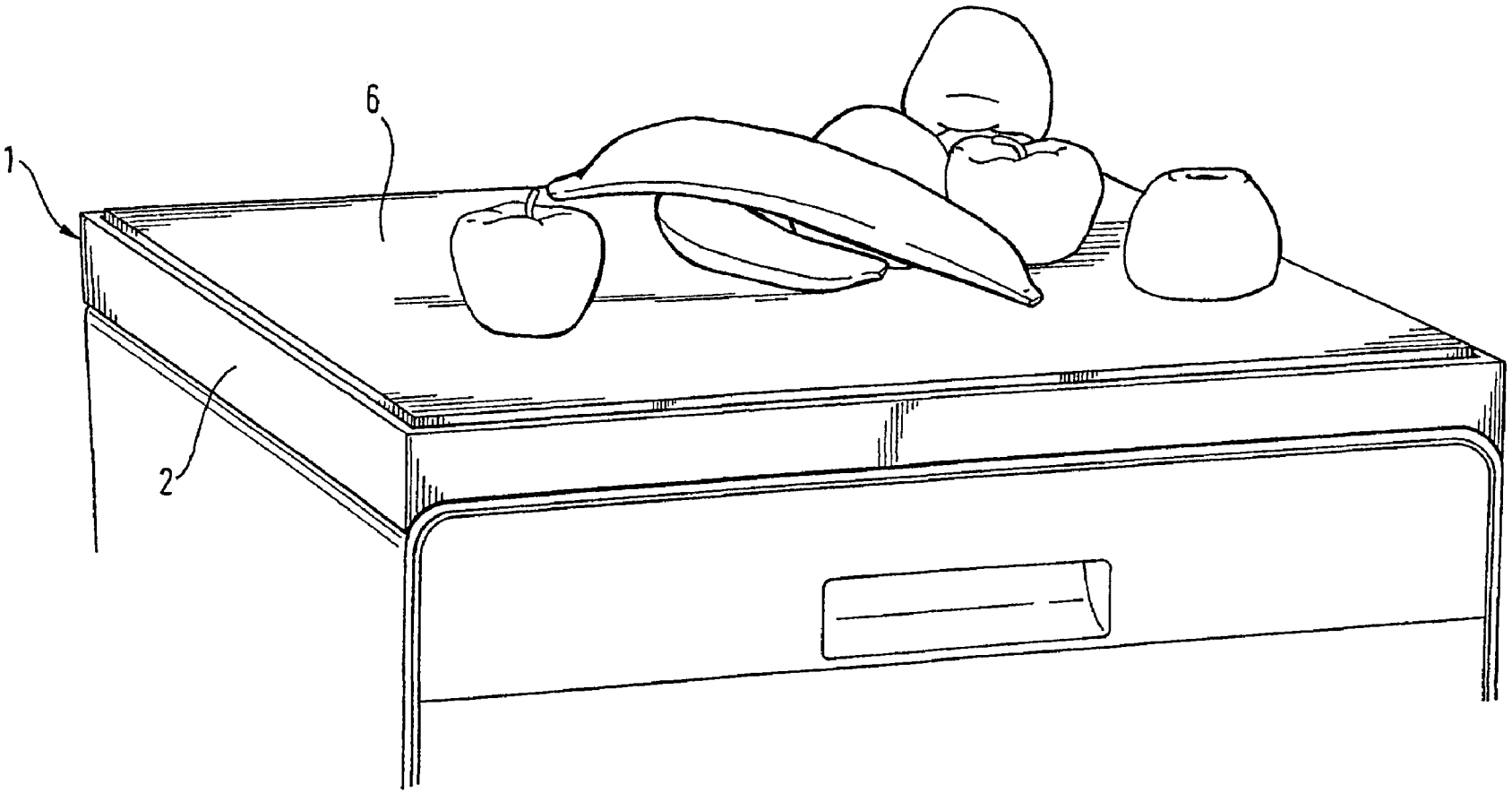
FIG. 4 is a perspective view of a cap according to the invention placed on an appliance, a surface of the cap being constructed as a cutting surface.

FIG. 4 represents another possible application of the cap 1, where the surface 6 of the cap 1 is constructed as a cutting surface. That way, vegetables, fruit, or meat can be sliced directly on the cap 1 during meal preparation. The surface 6 can be integral with the cap 1 or can be a separate plate that can be removed from inside the spaced defined by the margin 2.

As the above embodiments demonstrate, there are many possible applications of the cap 1. At the same time, such a cap 1 is relatively easy to produce and handle. A cap 1 for household appliances is, thus, created whose utility is substantially expanded.

I claim:

1. A household appliance cover for placement on top of a surface of a household appliance, the household appliance cover comprising:

a cap having a lower periphery and an upper periphery, at least a portion of said upper periphery having a raised margin and said raised margin of said upper periphery forming the sides of a trough-shaped tray for receiving therein a removable insertable part to be loaded with items, said lower periphery having a floor portion and a pair of opposed lateral ends each at a respective lateral side of said floor portion, each of said lateral ends of said lower periphery extending downwardly relative to said floor portion and said floor portion and said pair of opposed lateral ends being compatibly configured relative to a surface of a household appliance on which said household appliance cover can be placed such that said floor portion rests on the surface of the household appliance and each of said lateral ends extends downwardly below the surface of the household appliance as said floor portion rests on the surface of the household appliance, whereby said opposed lateral ends oppose lateral displacement of said cap relative to the household appliance; and a removable insertable part to be loaded with items, said removable insertable part operable to be removably inserted into, and retracted from, said raised margin of said upper periphery of said cap.

2. The household appliance cover according to claim 1, wherein said removable insertable part is a wire basket to be loaded with dishware.

* * * * *